United States Patent [19]

Glandon et al.

[11] Patent Number: 4,779,398

[45] Date of Patent: Oct. 25, 1988

[54] METHOD AND APPARATUS FOR MAKING GAS FLUSHED PACKAGES

[75] Inventors: James L. Glandon, Greer; Joseph E. Owensby, Spartanburg, both of S.C.

[73] Assignee: W. R. Grace & Co.-Conn., Cryovac Div., Duncan, S.C.

[21] Appl. No.: 11,796

[22] Filed: Feb. 6, 1987

[51] Int. Cl.[4] ..... B65B 31/08; B65B 31/06

[52] U.S. Cl. ..... 53/434; 53/479; 53/512

[58] Field of Search ..... 53/403, 408, 434, 467, 53/79, 86, 512, 479

[56] References Cited

U.S. PATENT DOCUMENTS

| | | | |
|---|---|---|---|
| 3,382,642 | 5/1968 | Shaw | 53/434 |
| 3,469,364 | 9/1969 | Bischoff | 53/434 |
| 3,958,391 | 5/1976 | Kujubu | 53/512 |
| 4,182,095 | 1/1980 | Day | 53/557 |
| 4,457,122 | 7/1984 | Atkins et al. | 53/434 |
| 4,471,599 | 9/1984 | Mugnai | 53/434 |
| 4,597,244 | 7/1986 | Pharo | 53/434 |

*Primary Examiner*—Horace M. Culver

*Attorney, Agent, or Firm*—John J. Toney; William D. Lee, Jr.; Jennifer L. Skord

[57] ABSTRACT

A method and apparatus for making gas flushed packages in a vacuum chamber machine which includes a bag mouth clamp spaced apart form seal bars disposed to transversely seal the bag neck. A vertically moveable piercing blade and nozzle penetrate the upper wall of the bag neck as the chamber pressure is lowered and the bag "balloons" thereby causing the upper and lower neck walls to separate. Once the bag is pierced and the residual air escapes, a predetermined amount of gas is injected and then the bag is sealed. If desired, sufficient gas can be injected to make a pillow pack.

16 Claims, 3 Drawing Sheets

METHOD AND APPARATUS FOR MAKING GAS FLUSHED PACKAGES

FIELD OF INVENTION

This invention relates to a method and apparatus for making gas flushed packages wherein the package comprises a product loaded into a flexible thermoplastic bag. More particularly, the invention relates to making a gas flushed package in a vacuum chamber and the product loaded within the thermoplastic bag is preferably shredded cheese, chopped meat, bakery products, and other food products whose storage life is extended by packaging in oxygen free, inert gas atmospheres. Specifically, the invention relates to making oxygen free packages where it is desirable that the difference in pressure between the inside of the package and atmospheric pressure is not great.

BACKGROUND OF THE INVENTION

The shelf life, both refrigerated and at room temperature, of many food products can be greatly extended if the food product is in a substantially oxygen free environment. One way of achieving the oxygen free environment is to simply evacuate the package to a very high level of vacuum. However, when flexible packaging is involved the use of a high vacuum can distort, compact, and crush the enclosed product as the vacuum is applied. For example, bakery products can readily be squeezed or compressed so they lose their appeal. Shredded cheeses can be compacted to such an extent that they have to be re-shredded, Swiss cheese with its holes can be distorted, and chopped meat products can be undesirably pressed. Accordingly, it is one object of the present invention to provide an oxygen free package of flexible packaging material wherein the contents of the package are not crushed or compressed by pressure differential.

Gas flush packaging has been used as an alternative to high vacuum packaging and quite often nitrogen is the inert gas of choice. When a vacuum chamber is used to evacuate and then gas flush a package it has heretofore been found necessary to clamp the package or bag mouth around a nozzle. A typical example of this is shown in U.S. Pat. No. 3,714,754 which issued on Feb. 6, 1973 to E. L. Holcombe et al. In FIGS. 2 and 8 of the Holcombe patent is shown a bag whose mouth is clamped around a nozzle within a vacuum chamber and this type of nozzle and clamp can be used to inject an inert gas into a bag after the air within the bag has been first evacuated. A similar device is shown in Canadian Patent No. 934,714 which issued Oct. 2, 1973 having as inventors, Philip L. Reid and John T. Roberts. In this latter patent a clamped bag mouth is shown and also the use of a flexible diaphragm is shown in FIG. 2 where the diaphragm under the influence of pressure difference presses against the bagged product and helps force air out of the bag. Also, U.S. Pat. No. 4,457,122 which issued July 3, 1984 to J. Harold Atkins et al also the use of a diaphragm to press air from a bag enclosing a product within a vacuum chamber. In order to evacuate a heat shrinkable bag within a chamber, a partially evacuated bag has been clamped, the chamber pressure lowered so that the bag balloons away from the product, the bag pierced as it balloons, and then the bag resealed by heat sealing. A patent disclosing some of these features is United Kingdom Patent No. 2,094,745B which has a priority date of Mar. 18, 1981 and is assigned to W. R. Grace & Co. Also, U.S. Pat. No. 4,182,095 which issued Jan. 8, 1980 to Timothy T. Day and Canadian Patent No. 1,060,402 which issued Aug. 14, 1979 show somewhat related processes. Still another patent which shows the evacuation of a bag within a chamber is U.S. Pat. No. 4,164,111 which issued on Aug. 14, 1979 to Pietro Di Bernardo.

A method of arranging a plurality of vacuum chambers for a commercial, relatively high speed process is shown in U.S. Pat. No. 3,958,391 which issued on May 25, 1976 to Eitaro Kujubu and whose disclosure is incorporated herein by reference. Similar vacuum chamber machines which are sometimes termed as "rotary vacuum chamber machines" are also disclosed in U.S. Pat. No. 4,580,393 which issued Apr. 8, 1986 to Takao Furukawa and U.S. Pat. No. 4,586,328 which issued on May 6, 1986 to Takao Takai et al and the contents of these two patents are incorporated herein by reference.

It is a general object of the present invention to provide an improvement in the foregoing vacuum chamber machines and evacuation processes by providing a method and apparatus for making a gas flushed package. These and other objects will become readily apparent to those skilled in the art from the following summary of the invention, description of the drawings, and detailed description.

SUMMARY OF THE INVENTION

In one aspect, the present invention is an improvement in the method of making a gas flushed package composed of a product within a flexible container wherein the improvement comprises clamping the neck of the container loaded with the product; lowering the pressure external to the container; piercing one wall of the container and the neck area as it inflates and separates the container walls in the neck; injecting gas into the container through the pierced opening; and, thereafter, sealing the container between the pierced opening and the product.

In another aspect, the present invention is a method for making gas flushed packages in a vacuum chamber comprising the steps of: placing a loaded gas impervious bag in a vacuum chamber; clamping the bag neck; closing and partially evacuating the chamber thus causing the bag to balloon and the bag walls in the neck area to separate; piercing the upper, separated bag wall with sharpened nozzle means to allow trapped air inside the ballooned bag to escape; continuing the evacuation of the chamber and consequently evacuating the pierced bag; stopping the chamber evacuation and injecting gas through the nozzle into the bag; and, heat sealing the bag between the point at which the bag is pierced and the product is loaded into the bag thereby providing a gas flushed package.

In still another aspect, the present invention is an improvement in an apparatus for making gas flushed packages in a vacuum chamber having bag mouth clamping means, seal bars spaced apart from the clamping means to transversely seal the bag neck, and bag piercing means located between the injection means associated with the piercing means, said piercing means and gas injection means being vertically movable when the chamber pressure is lowered to pierce the upper bag neck wall as it separates from the lower bag neck wall as the bag inflates.

In yet another aspect, the present invention is an apparatus for making gas flushed packages comprising: a vacuum chamber for receiving a thermoplastic bag loaded with product; a bag clamp for clamping and closing the bag mouth when the loaded bag is placed in the chamber; sealing bars spaced apart from the clamp and disposed to heat seal the bag neck transversely to hermetically close the bag; vertically movable piercing means located between the bag clamp and the sealing bars and above the bag neck whereby when the pressure is lowered in the chamber and the bag mouth is clamped and closed, the walls of the bag neck will separate as the bag inflates and downward movement of the piercing means pierces and penetrates only the upper neck wall of the bag; means associated with the piercing means to inject gas into the bag; and, means to close the seal bars and the bag after a predetermined quantity of gas has been injected therein.

DESCRIPTION OF THE DRAWINGS

In the drawings which are appended hereto and made a part of this disclosure.

DETAILED DESCRIPTION

Figure 1:
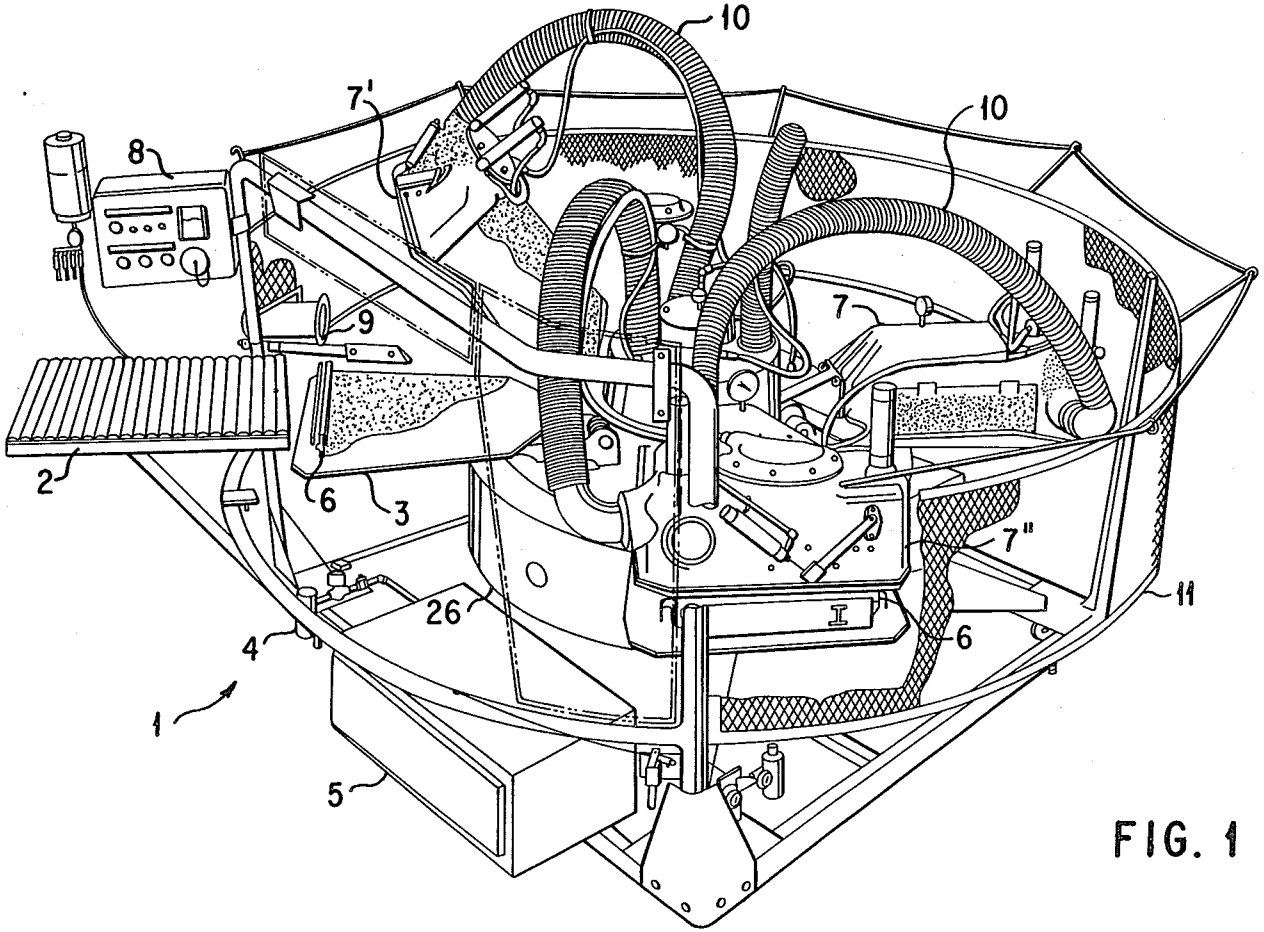
FIG. 1 is a perspective view of a rotary vacuum chamber machine which is a preferred type in which the present invention can be adapted.

Looking first at FIG. 1, a rotary vacuum chamber machine 1 is shown in perspective with cut away sections. The basic elements of the machine will be pointed out and their operation generally described. For more detailed description of these machines reference is made to U.S. Pat. Nos. 3,958,391; 4,580,393; and 4,586,320 mentioned above. The machine is best understood by describing its mode of operation. A product to be packaged, commonly a cut of meat such as a beef round, tenderloin, block of cheese, or other similar food product will arrive on the in feed conveyor 2 loaded into a thermoplastic bag which usually is a gas impervious bag so that it will maintain a vacuum. The bagged product is transferred onto receiving platen 3 where the mouth of the bag is laid across bottom or lower seal bar jaw 6. The platen is mounted to a central spindle assembly 26 from which vacuum chamber heads 7 are cantileverly mounted by pivots to be raised and lowered. Connected to each chamber is a vacuum hose line 10. As the platen 3 moves in rotary fashion counterclockwise the chamber 7 is lowered as can be seen where platen 6'' is at the point where the vacuum chamber head 7'' is about to be lowered and closed. As the chamber is closed and moves around in rotary fashion, vacuum is applied to the chamber consequently evacuating the bag. Then the seal bars close and the excess film extending beyond the seal bar is cut off. This excess film is removed when the chamber is opened through scrap removal duct 9. The operator is able to control the operation at the control box 8. Air supply 4 supplies compressed air for the pneumatic cylinders as the chambers are raised and lowered by pneumatic cylinders. An electrical control box 5 provides control for the electrical switches that control and regulate the process. All of these controls are well known to those skilled in the art. In addition, safety guard 11 surrounds the rotary chambers to prevent personnel from coming into contact with the moving vacuum chambers.

Figure 2:
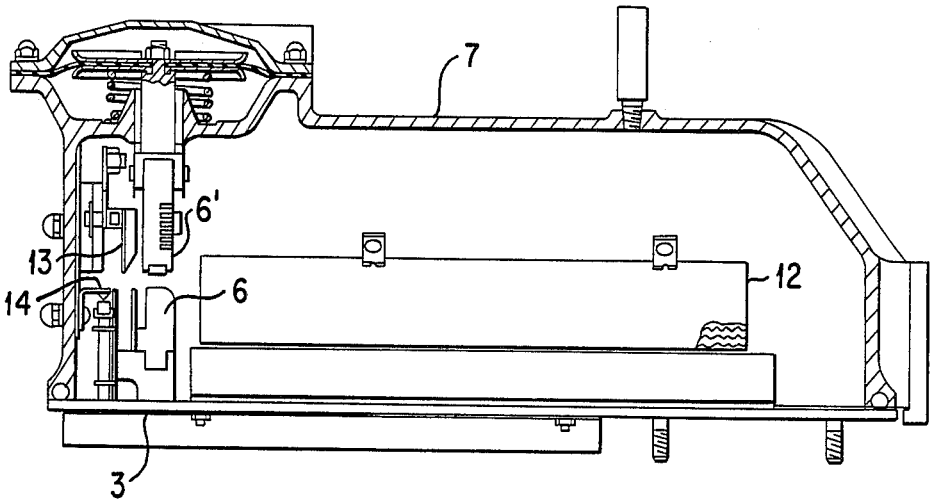
FIG. 2 is an elevation view in cross-section of one of the vacuum chambers in the rotary vacuum chamber machine of claim 1 showing a preferred arrangement of apparatus according to the present invention.

Looking now at FIG. 2, the cross section of a vacuum chamber with the head 7 closed onto the base platen 3 is shown. Lower seal bar 6 is shown with the upper or mating seal bar 6' positioned above it for reciprocal motion up and down to seal a bag whose neck would be disposed between the seal bar jaws and be clamped by bag mouth clamp 14. The piercing means assembly 13 is also shown mounted for reciprocal vertical motion upon signal. Also in FIG. 2 is shown chain mail curtain 12 which can be draped over the product.

Figure 4:
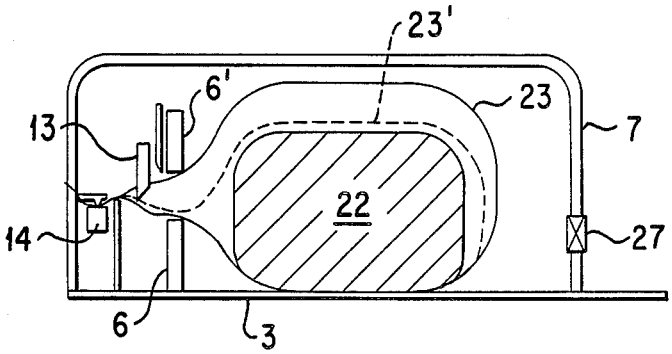
FIG. 4 is a perspective view of a longitudinal cross-section of a vacuum chamber according to the present invention showing a ballooned bag with a product therein.
Figure 5:
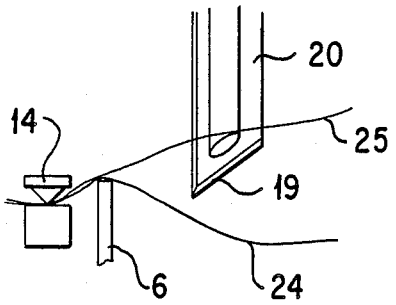
FIG. 5 is a schematic representation of a section of a bag neck which has been separated as the bag balloons under reduced pressure within a vacuum chamber showing one embodiment of a piercing means according to the present invention.
Figure 6:
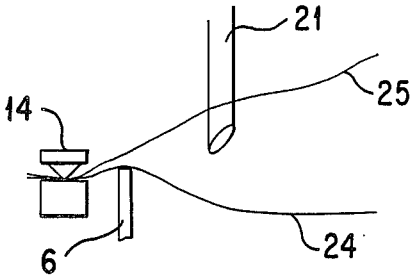
FIG. 6 is an alternate embodiment of the piercing means shown in FIG. 5.
Figure 7:
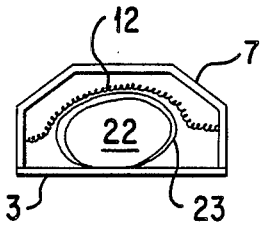
FIG. 7 shows the collapse, upon a ballooned bag, of the pressing means which pushes air out of a bag; and, FIG. 8 shows the pressing means prior to its collapse upon the bag containing a product.
Figure 8:
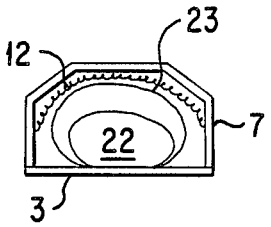

Moving now to FIG. 4, which is a schematic representation of a chamber such as that shown in FIG. 2, bag 23 containing a product 22 is illustrated. At the stage shown in FIG. 4, the mouth of uninflated bag 23' has been clamped by clamp 14 and the neck of the bag has been laid between seal bars 6 and 6'. When the bag mouth and neck are first laid across the seal bar and clamped, the bag neck walls 24 and 25 are in contact superposed one on the other as represented by the dotted lines for uninflated bag 23'. When the chamber is closed and vacuum is drawn in the chamber the bag will balloon outwardly as represented in FIG. 4. In FIGS. 5 and 6 a detailed representation of the separation of bag neck walls 24 and 25 is given. The ballooning occurs, of course, because the pressure within the bag is essentially atmospheric and the pressure within the chamber outside of the bag has now dropped well below atmospheric. In the preferred mode of operation, the evacuation is halted before the chamber is evacuated to a high vacuum and the piercing and gas injection assembly 13 is lowered to pierce the bag. When this happens, the air within the bag will rush out through the pierced openings in the space between the edge of the opening and the knif and the bag will tend to collapse upon the product 22. To aid in the further removal of air from the bag, an optional, but preferable, chain mail curtain 12 which has been positioned as shown in FIG. 8, which is a transverse cross-section in schematic representation, will be lowered to collapse upon and to press the air out of the bag as shown in FIG. 7. The penetration of the needle into the bag is shown in greater detail in FIGS. 5 and 6 where alternative embodiments of the piercing and gas injecting means 13 are shown. The evacuation of the chamber continues to a high vacuum level, preferably greater than 26 inches Hg. at which time further evacuation is discontinued and the chain mail curtain 12 is raised to the position shown in FIG. 8. At this point, gas is introduced through the gas injection nozzle 20 as in FIG. 5 or preferably through sharpened nozzle 21 as in FIG. 6 and the bag is flushed with the desired inert gas. Sufficient gas can be pumped in to inflate the bag and cause it to have the appearance again as in FIG. 4. At this stage virtually all of the residual oxygen will have been removed from the bag as when the bag is sufficiently inflated gas will begin to flow out around the nozzle and blades at the pierced openings. At this point, to control the rate of inflation of the bag, it is desirable to bleed atmospheric air into the chamber. This is schemically represented by valve 27 in FIG. 4 which admits or bleeds in atmospheric air in a controlled manner. This serves two purposes; one being to reduce the possibly of rupturing the bag as gas is injected and the bag is rapidly inflated and the other being to provide pressure outside the bag so as to reduce the gas leakage out of bag around the space between the pierced openings and nozzles. The time required to inject this amount of gas and the pressure at which it is injected can readily be determined by trial by those skilled in the art. Once the gas flushing has been completed, the seal bars 6 and 6' close transversely sealing the bag after which the chamber is aerated and the atmospheric pressure will tend to collapse the bag back onto the product. The placement and connection of the various controls, mountings, switches, solenoids, and pneumatic cylinders to operate the seal bars, clamp, piercing and gas injection assembly are within the skill of those familiar with the art of packaging machines.

If the product is one which would be damaged or compressed undesirably by restoration of atmospheric pressure on the outside of the flexible package, inert gas, preferably nitrogen, in sufficient quantity can be injected so that a pressure above atmospheric pressure will result within the bag. Thus, once the chamber is aerated the bag's internal pressure will prevent a collapsing of the bag against the product. This results in a "pillow pack" type of package.

Figure 3:
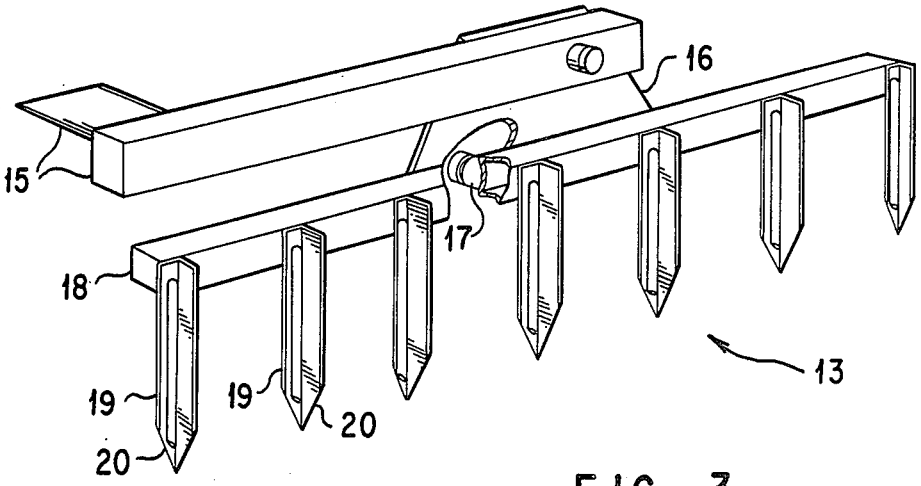
FIG. 3 is a perspective drawing of a preferred piercing apparatus and gas injection means which form a part of the present invention.

One embodiment of the piercing and gas injecting means 13 is shown in FIG. 3 where L-shaped knife blades 19 are attached to and depend from distribution manifold 18 which receives inert gas through gas supply line 17. The manifold is carried by adjustable support 16 which is attached to vertically movable support frame members 15. This array of the L-shaped knife means 19 with the tubular nozzles 20 in the vertex of the "L" corresponds to the embodiment shown in FIG. 5. A preferred embodiment is shown in FIG. 6 which employs a tubular gas injecting nozzle 21 which is pointed and sharpened so that it can also perform the piercing function. An array of these nozzles can be provided in a similar fashion as shown in FIG. 3 where the blades 19 are removed and the nozzles 20 are sharpened and pointed to appear as nozzles 21 in FIG. 6. In still other alternate embodiments there could be one or two downwardly depending blades 19 from manifold 18 without nozzles associated therewith which serve purely to pierce the bag and also downwardly depending nozzles 21 from manifold 18 to inject gas. Air withdrawal nozzles have been tried, i.e., piercing nozzles connected to a vacuum source, but while evacuation of the bag is improved, withdrawal of air through relatively narrow nozzles tends to clog the nozzles as moisture and fluids from the products will tend to be withdrawn.

The preferred embodiment described hereinabove included the use of the chain mail curtain 12 as shown in FIGS. 7 and 8 as the preferred method of pressing as much residual air from the bag as possible. However, in some processes where speed is essential or for other reasons it may not be desirable to use the relatively heavy chain mail curtain. Thus, the inclusion of the chain mail curtain is also an alternate embodiment.

The material from which bags are made has to be of sufficient strength to withstand the puncture and piercing and not split or tear. A tendency to "self-seal" around the nozzles during gas injection is tendency which is also helpful in reducing leakage of gas, preferably nitrogen, during the gas injection stage. Of course, atmospheric air bled in during the gas injection phase from valve 27 will aid in the "self-sealing" tendency of the film to the nozzle in the pierced opening areas.

While an embodiment of the invention with alternatives has been shown and described, the invention is not limited to the specific construction thereof which is merely exemplary in the specification rather than being defined. The invention is defined and limited only by the claims which follow.

We claim:

1. A method for making gas flushed packages in a vacuum chamber comprising:

(a) placing a loaded gas impervious bag in a vacuum chamber;

(b) clamping the bag neck to close and hold the bag;

(c) closing and partially evacuating the chamber thus causing the bag to balloon and the bag walls in the neck area to separate;

(d) piercing the upper, separated bag wall with sharpened nozzle means to allow trapped air inside the ballooned bag to escape into the chamber;

(e) continuing the evacuation of the chamber and consequently evacuating the pierced, ballooned bag;

(f) stopping the chamber evacuation but maintaining the lowered pressure within the chamber and injecting gas through the nozzle into the bag; and (g) heat sealing the bag between the point at which the bag is pierced and the product loaded in the bag thereby providing a gas flushed package.

2. The method of claim 1 including after step (d) the step of applying mechanical pressure to the outside of the ballooned bag to assist in collapsing the bag and removing residual air therefrom.

3. The method of claim 1 including in step (f) the step of injecting sufficient gas whereby when the chamber is restored to atmospheric pressure the gas pressure within the bag will be greater than atmospheric pressure thus creating a "pillow pack."

4. In the method of making a gas flushed packaging having a product within a flexible container the improvement which comprises:

(a) clamping the neck of the container loaded with the product;
(b) lowering the pressure external to the container;
(c) piercing the one wall of the container in the neck area as it inflates and separates the container walls in the neck as the external pressure is lowered.
(d) allowing air within the bag to escape to the space surrounding the container and then injecting gas into the container through the pierced opening; and, thereafter,
(e) sealing the container between the pierced opening and the product.

5. The method of claim 4 including, after step (c) and before step (d), the step of pressing the outer surface of the container to force air trapped herein out through the pierced opening.

6. The method of claim 4 wherein the injection of gas is sufficient to increase the pressure in the container to above atmospheric pressure thus creating a "pillow pack" package.

7. The method of claim 4 including the step of raising the pressure external to the container during step (d).

8. An apparatus for making gas flushed packages comprising:

(a) a vacuum chamber for receiving a thermoplastic bag loaded with product;
(b) a bag clamp for clamping and closing the bag mouth when the loaded bag is placed in the chamber;
(c) sealing bars spaced apart from the clamp and disposed to heat seal the bag neck transversely to hermetically close the bag;
(d) vertically movable piercing means located between the bag clamp and the sealing bars and above the bag neck whereby when the pressure is lowered in the chamber and the bag mouth is clamped and closed, the walls of the back neck will separate as the bag inflates and downward movement of the piercing means pierces and penetrates only the upper wall of the bag;
(e) means associated with the piercing means to inject gas into the bag; and,
(f) means to close the seal bars and the bag after a predetermined quantity of gas has been injected therein.

9. The apparatus of claim 8 wherein the piercing means is an "L" sectioned piercing knife and the means for injecting gas is a tubular nozzle positioned longitudinally in the vertex of the knife "L" section.

10. The apparatus of claim 8 wherein the piercing means and means for injecting gas comprise a sharpened nozzle.

11. The apparatus of claim 9 including a plurality of "L" shaped knives with tubular nozzles associated therein.

12. The apparatus of claim 10 wherein the piercing and gas injecting means comprising including a plurality of sharpened nozzles.

13. The apparatus of claim 8 including means for pressing the outer surface of the bag to remove air therefrom when the bag is pierced.

14. The apparatus of claim 13 wherein said means for pressing the outer surface of said bag is a chain mail curtain extending across the width of the chamber above the bag and having means associated therewith to alternatively raise the curtain and drape it on and over the bag as it inflates.

15. In an apparatus for making gas flushed packages in a vacuum chamber having bag mouth clamping means, seal bars spaced apart from the clamping means to transversely seal the bag neck, and bag piercing means located between the sealing bars and the clamping means, the improvement which comprises gas injection means associated with the piercing means, said piercing means and gas injection means being vertically movable when the chamber pressure is lowered to pierce the upper wall of the bag neck as it separates from the lower bag neck wall as the bag inflates.

16. The apparatus of claim 15 including valve means to admit atmospheric air into said vacuum chamber while gas is injected by the gas injection means.

* * * * *